US005309145A

United States Patent [19]

Branch et al.

[11] Patent Number: 5,309,145

[45] Date of Patent: May 3, 1994

[54] TRAVEL CONVENIENCE AND SECURITY DEVICE

[75] Inventors: Allan C. Branch, South Hobart, Australia; Gregory W. O'Connor, Littleton; Barbara A. Thurston, Westminster, both of Colo.

[73] Assignee: Samsonite Corporation, Denver, Colo.

[21] Appl. No.: 877,403

[22] Filed: May 1, 1992

[51] Int. Cl.[5] ..... G08B 13/18; G08B 17/10; G08B 23/00

[52] U.S. Cl. ..... 340/540; 340/541; 340/567; 340/628; 340/691; 362/253; 362/802; 368/11

[58] Field of Search ..... 340/567, 693, 691, 541, 340/540, 628; 368/11, 10; 362/253, 802

[56] References Cited

U.S. PATENT DOCUMENTS

| | | | |
|---|---|---|---|
| 3,459,961 | 8/1969 | Ravas | 307/116 |
| 4,263,665 | 4/1981 | Watts | 340/384 E |
| 4,433,328 | 2/1984 | Saphir et al. | 340/555 |
| 4,703,171 | 10/1987 | Kahl et al. | 250/221 |
| 4,751,399 | 6/1988 | Koehring et al. | 307/117 |
| 4,910,652 | 3/1990 | Rhine | 362/234 |
| 4,943,712 | 7/1990 | Wilder | 250/221 |
| 4,949,077 | 8/1990 | Mbuthia | 340/693 |
| 4,992,701 | 2/1991 | Sacchetti | 315/159 |
| 5,015,994 | 5/1991 | Hoberman et al. | 340/567 |
| 5,146,209 | 9/1992 | Beghelli | 340/691 |

OTHER PUBLICATIONS

Advertisement, Home Magazine, Mar. 1991, p. 30.
Cat's eye Motion Detector, Model 7050, Westek.
Adv., Avon Campaign 17, Summer 1992 Sale Catalog p. 21.
Adv., Popular Science, Mar. 1991, p. 15.
Adv., Popular Science, Oct. 1991, p. 94.
Adv., Star Case Catalog, pp. 16, 17, 23, 15.
Advertisements, Airborne Express, pp. 32 & 33.
Portaguard, PP 700, use instructions.
Adv., p. 71, unknown catalog, ceiling projector clock.

*Primary Examiner*—Glen R. Swann, III
*Attorney, Agent, or Firm*—John R. Ley

[57] ABSTRACT

A clock, a lamp, an alarm, a motion detector and a smoke alarm are advantageously combined in a travel device which provides the user with both convenience and security when travelling. The motion detector detects motion and controls the delivery of an alarm signal and/or the delivery of light from the lamp. If motion occurs under circumstances suggesting that an intruder is present or if smoke is detected, the alarm signal and the degree of illumination alert the user to a potential security concern. If motion occurs under circumstances indicating the user is present and engaging in normal activities, the illumination is sufficient for those activities. If motion is not detected during a predetermined time period, suggesting that the user has gone to sleep, the illumination is ended. The alarm and the illumination may also be activated by clock functions, thereby achieving alarm clock functionality.

35 Claims, 6 Drawing Sheets

TRAVEL CONVENIENCE AND SECURITY DEVICE

This invention relates generally to a new useful combination of convenience and safety components in a single device that travelers will find particularly useful, although the device may be equally useful for everyday use in an individual's home or dwelling. More particularly, the present invention relates to a new and useful combination, in a single device, of an information providing component, such as a clock and an alarm; an illumination component, such as a lamp or other source of illumination; and a personal security or condition detecting component, such as a motion detector or a smoke detector; all of which interact with one another to provide conveniences and improvements for the user.

BACKGROUND OF THE INVENTION

There are a variety of different types of security devices currently available. For example personal security systems detect the presence of motion and turn on lights or deliver alarm signals or both. Smoke detectors detect the presence of smoke and deliver alarm signals. Auxiliary lighting systems are available to create illumination in stairways and fire exit areas when fires or fire conditions are detected. While these types of security systems are generally adequately functional, they are generally installed in single fixed locations in homes and offices. Most of such systems are not readily transportable for use by the user to different locations, such as when travelling.

One potentially disconcerting problem with travelling is staying in unfamiliar accommodations. It can be difficult and disconcerting to remember the physical orientation of an unfamiliar guest room in the dark, and even more difficult or disconcerting to find light switches, alarm clocks, telephones, toilets and other facilities which may need the traveler's attention in the dark. Also, a disoriented traveler may reflexively wonder what time it is and fumble for a wristwatch or to locate a clock in the unfamiliar room.

Not only can the environment of the guest room be unfamiliar, and therefore somewhat disconcerting, but the traveller frequently knows little if anything about the reputation for safety of the lodging establishment in which he or she is staying. Some travelers are particularly concerned about fires or personal assaults from intruders, even in establishments of the best reputation, simply because of greater diversity of people who utilize such establishments.

A traveler who finds these considerations disconcerting may have difficulty in getting to sleep. Reading prior to retiring may divert the traveler's mind, but sometimes the traveler will drift off to sleep while reading. If the traveler awakens later, he or she may wish to turn off the light to go back to sleep, thus further rousing from sleep. Falling asleep a second time after being awakened can be difficult. Also, some travelers might appreciate a relatively dim night light to derive comfort for some of these considerations, but night lights are generally not available as standard guest accommodations.

Most travelers depend heavily on wake up calls or alarm clocks to awaken them. Although the reliability of a wake up call is generally very good, mistakes do occasionally happen. Some lodging establishments provide alarm clocks for the guests to use as an alternative to or in conjunction with the wake up calls. However, some of the more sophisticated alarm clocks are combined with radios and televisions, and are difficult to use. Consequently many travelers do not use these types of alarms because of the difficulty or uncertainty associated with setting them. Also some travelers question the reliability of operation of these devices. Many travelers use their own alarm clocks, known as travel alarm clocks, for these reasons.

It is because of these and other background considerations that the present invention has evolved.

SUMMARY OF THE INVENTION

The general objective of the present invention is to make travelling more convenient and secure by eliminating the uncertainties caused by the concerns and strangeness of unfamiliar accommodations, as well as providing these same advantages and benefits for use in a home or dwelling.

In accordance with one of its aspects, the present invention relates to a new and useful combination of a clock means for counting time, a display means for displaying time information, an alarm means for selectively delivering an alarm indication in an ambient environment, a condition detecting means for detecting a predetermined condition in the ambient environment, and means which interconnects the clock means, the display means, the alarm means and the condition responsive means and which is operative to activate the alarm means upon the condition detecting means detecting the predetermined condition, to activate the alarm means upon the clock means counting to a predetermined time, and to activate or illuminate the clock display means. Preferably the condition responsive means is a motion detector and/or a smoke detector. The motion detector detects the presence of motion in an ambient environment, which generally will be a guest room of a lodging establishment, and alerts the user to motions such as that which would occur from an intruder. The alarm means preferably provides an audible alarm indication to the user. The smoke detector provides an early warning of a potential fire hazard. The components are preferably contained in a housing of a size which allows the traveller to conveniently pack the device in a suitcase, purse, or pocket. As a consequence, the present invention provides a traveller or other user with an early warning of conditions which could give rise to a security concern.

In accordance with another one of its aspects, the present invention relates to a new and useful combination of a source of illumination for illuminating the ambient environment primarily in one direction, alarm means for selectively delivering an audible alarm indication in the ambient environment, motion detector means for detecting motion in the ambient environment in a direction different than of the illumination, and means for activating either the illumination source or alarm means or both upon the motion detector means detecting motion. The inclusion of the illumination source provides illumination within the ambient environment, thereby allowing the traveller to read a clock display, to find the various facilities in the guest room, and to observe the unfamiliar surroundings in a guest room, among other things. The use of the motion detector in conjunction with the illumination source allows the user to both activate the device without actually manually touching it, which is desirable in unfamiliar surroundings. The inclusion of a smoke detector in addition to the motion detector obtains illumination if the user must escape a fire hazard condition.

In accordance with a further one of its aspects, the present invention relates to a new and useful combination of a source of illumination for selectively relatively brightly illuminating the ambient environment and for selectively relatively dimly illuminating the ambient environment, a motion detector means for detecting motion in the ambient environment, and means for activating the illumination source to brightly illuminate the ambient environment upon the motion detector means detecting motion and to dimly illuminate the ambient environment upon the motion detector means detecting motion, and means for deactivating the illumination source after the motion detector means detects no motion. This particular combination of components allows the device to be used not only for security purposes, but also to be used as a night light. Illumination will be maintained so long as motion is detected, such as when the user is reading by turning pages of a book, but will thereafter deactivate the light, such as when the user goes to sleep. However, if the user awakens and needs to find the facilities in the room or read a clock display, a wave of the hand or other movement, which is more than typically occurs while sleeping, will automatically activate the illumination source so the user can find his or her way. Furthermore, two levels of illumination are provided, a brighter one for reading and the like, and a dimmer one for general illumination in unfamiliar surroundings. So long as motion is detected under either illumination condition, that level of illumination is maintained.

A more complete appreciation of the present invention and its scope can be obtained from understanding the accompanying drawings, which are briefly summarized below, the following detailed description of a presently preferred embodiment of the invention, and the appended claims.

DETAILED DESCRIPTION

Figure 1:
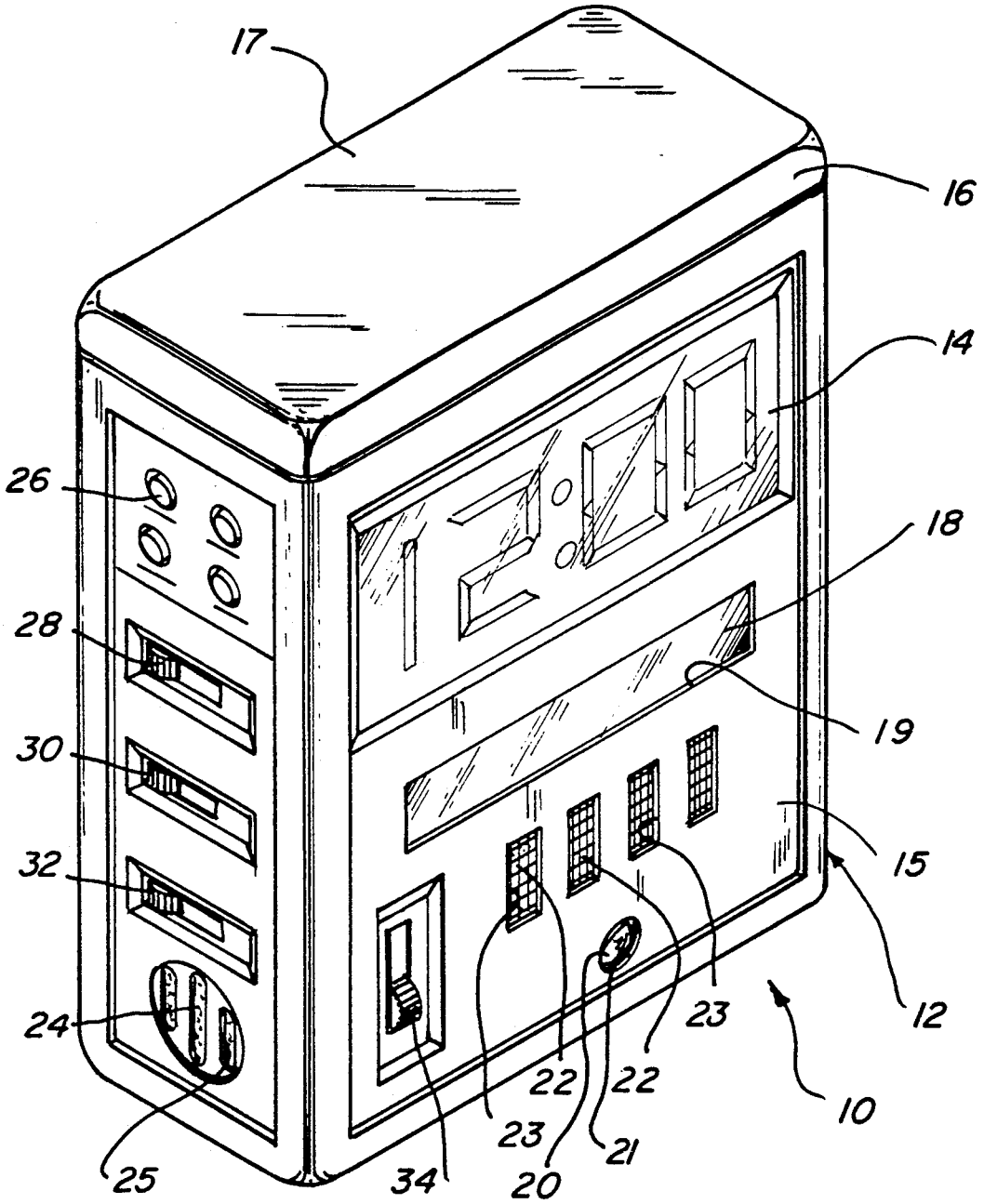
FIG. 1 is a perspective view of an exemplary device implementing the present invention.

The components of the present invention may be advantageously incorporated into an exemplary apparatus or device 10 such as that shown in FIG. 1. The device 10 has an outer housing or casing 12 within which various functional elements of the device are retained. A conventional clock display 14 is attached to a front surface 15 of the casing 12. A lamp 16 is positioned within the casing to illuminate the clock display 14 and also to shine light through a transparent window or lens 17 which forms a top surface of the casing 12. The lamp 16 and lens 17 are an example of a source of illumination which creates a generally upward transmission of the light to maximize the area illuminated by the lamp 16. The lens 17 may be a Fresnel lens or a frosted or diffusing window to control the dispersion or focus of the light emitted and to direct the light therefrom in a first direction, preferably generally upward to provide general illumination to the ambient environment.

A conventional motion detector 18 is located behind a window 19 in the front surface 15. The motion detector 18 is preferably of the conventional dual-element, passive infrared type. The window 19 is preferably a fresnel or other type of lens which focuses the radiant energy and controls the angle and direction of radiant energy to which the motion detector 18 is responsive. The lens in the window 19 may be advantageously employed to establish a differential in radiant energy across the two elements of the motion detector, when motion occurs. Movement is therefore more readily detected. The motion detector is also oriented in a second or different direction than the direction of illumination by the lamp 16 and lens 17. This second direction is preferably to detect motion from a different direction than the direction of illumination. As a consequence, the illumination will not tend to blind the user, if the user looks at the device 10 to observe the time or to adjust it. The lens in the window 19, or the orientation of the motion detector, allows a directionality of the path of the sensed movement, which is advantageous, as discussed below. Other types of conventional motion detectors may be employed, such as ultrasound doppler devices.

A conventional ambient light sensor 20 is located behind an aperture 21 formed in the front surface 15. A conventional smoke detector 22 is located behind a series of openings 23 which permit ambient air to pass to the smoke detector 22. A conventional sound generating device such as a buzzer, speaker or alarm 24 is located behind another opening 25. In general, the lamp 16 and the lens 17, the motion detector 18, the smoke detector 22 and the alarm 24 are intended to be primarily operative in an ambient environment generally surrounding the device 10, which in most cases will be a guest room in a lodging establishment.

One or more clock control switches 26 are located at an exterior surface of the casing 12. The switches 26 are used for setting the time of day (preferably both the local and the traveler's home time), an alarm time, a date or calendar time, and other time-related information typically available from the clock display 14. A clock alarm switch 28 controls the existence of and type of alarm condition produced by the alarm 24. An alarm switch 30 controls the operation of the alarm 24 in response to other conditions which do not involve the clock display 14, as described more fully below. A switch 32 controls the operation of the smoke detector 22. A mode control switch 34 allows the selection of two different types or modes of operation of the elements of the device 10 and selection of a third mode where the elements, other than the clock and clock display 14, are inoperative. The clock and the display are preferably continually energized by a battery. The mode switch 34 may also have an additional position to test the power level of one or more batteries used to power the device 10. A signalling device such as a light emitting diode (not shown) is activated upon placing the mode switch in the battery test position when the battery power level is sufficient. Use of the mode switch for testing is advantageous for portable battery powered devices 10, to eliminate the constant battery drain that would occur with constant energization of the signalling device while the battery power level remains satisfactory. In general, the device 10 is of a size convenient for packing in a traveller's suitcase.

Figure 2:
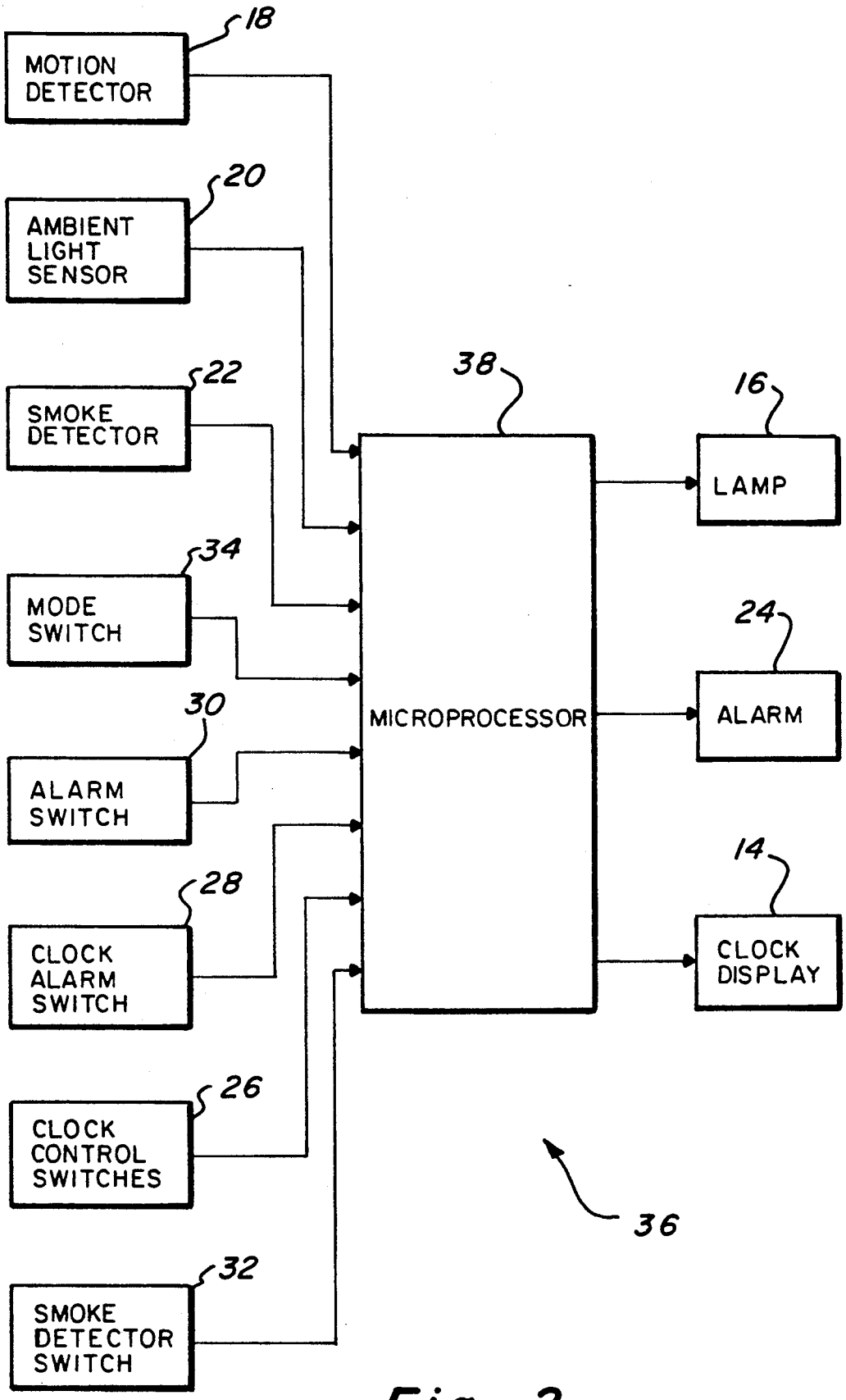
FIG. 2 is a block diagram representing the functional components of one embodiment of the device shown in FIG. 1.

The interrelationship of the functional elements of the device 10 in a functional system 36 is illustrated in FIG. 2. The motion detector 18, the ambient light sensor 20, the smoke detector 22, the mode switch 34, the alarm switch 30, the clock alarm switch 28, the clock control switches 26 and the smoke detector switch 32 are all connected to supply input and control signals to a microcomputer or microprocessor 38. The functionality of the microprocessor 38 is established by software programming recorded in its memory. The input and control signals to the microprocessor 38 interact with its programmed functionality to control the clock display 14, the lamp 16, and the alarm 24 in response to control signals delivered from the microprocessor 38. All of the elements are functionally interconnected by the plurality of signal carrying conductors. In some situations, the functionality of the microprocessor 38 may be achieved from an array of logic gates, non-volatile or volatile memory devices, a clock and/or a microcontroller, or a number of clocked shift registers, rather than a complete microcomputer.

At least one battery or other energy source (neither shown) supplies energy for the elements shown in FIG. 2. Preferably two power supplies are used; one power supply connected to the microprocessor 38 and the clock display 14 by which to achieve time keeping functions, and another power supply connected to and energizing the other elements. Having two power supplies ensures that power will be reliably available for the clock functions, which are typically achieved with low power drain, even in the event that the other higher power consuming components drain the power from the other power source.

Typically the clock display 14 will be activated for continual time keeping operation, but the microprocessor will cause the clock display 14 to display information established by the signals supplied by the clock control switches 26, such as the alarm time, a morning or afternoon indication, showing the current time in a different time zone, an alarm active/inactive indication, a day/date indicator and other clock or time related information. The alarm 24 is controlled to produce different patterns of alarm indications, such as loud and soft audible tones, different frequency tones or a different type of indication such as a chime-like tone, according to the type of event announced by the alarm 24. The lamp 16 is also controlled to achieve different types of illumination such as bright, dim or flashing light.

Figure 3A:
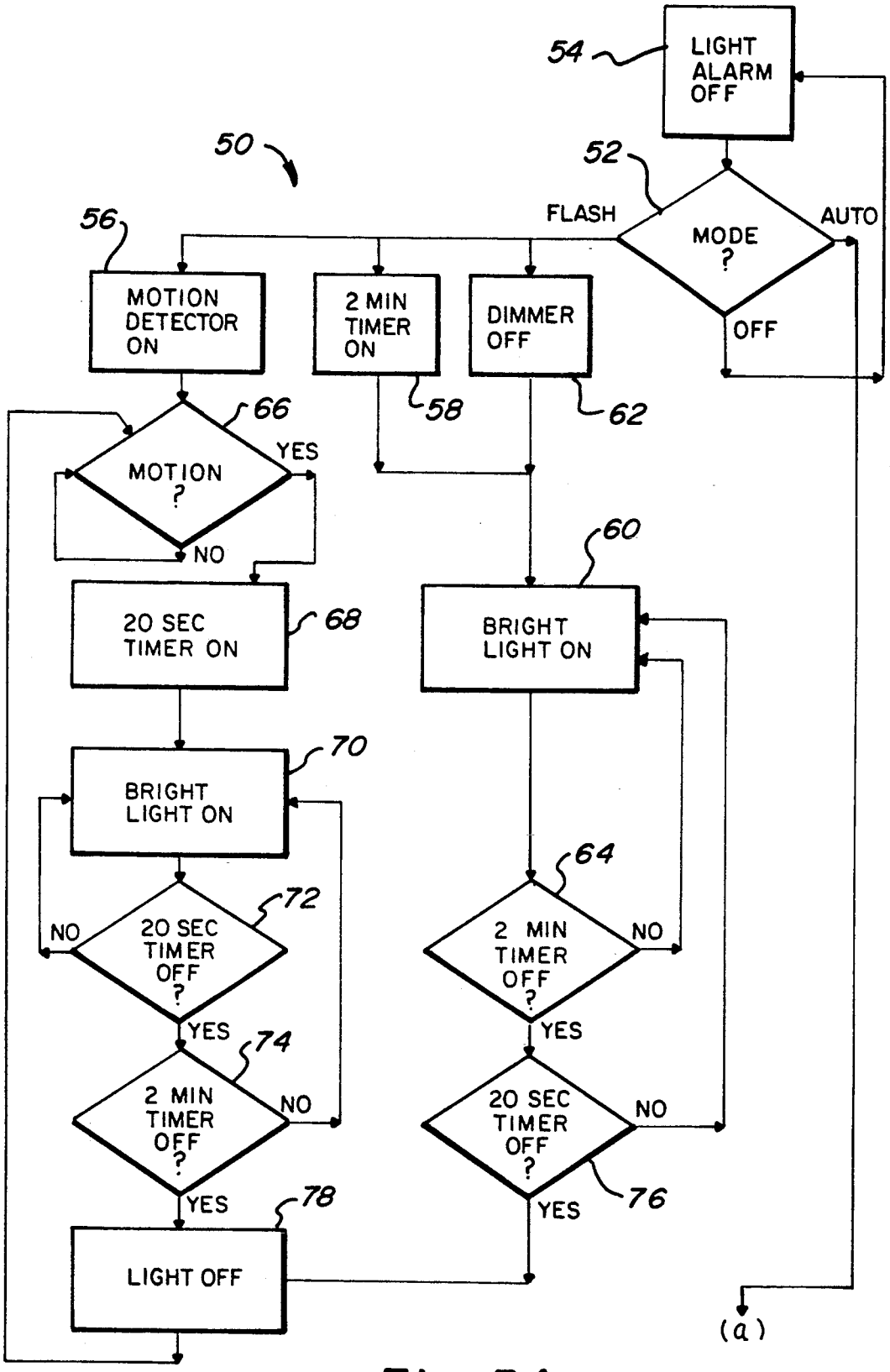
FIGS. 3A and 3B form a single flow chart of the logical operation of the components shown in FIG. 2.
Figure 3B:
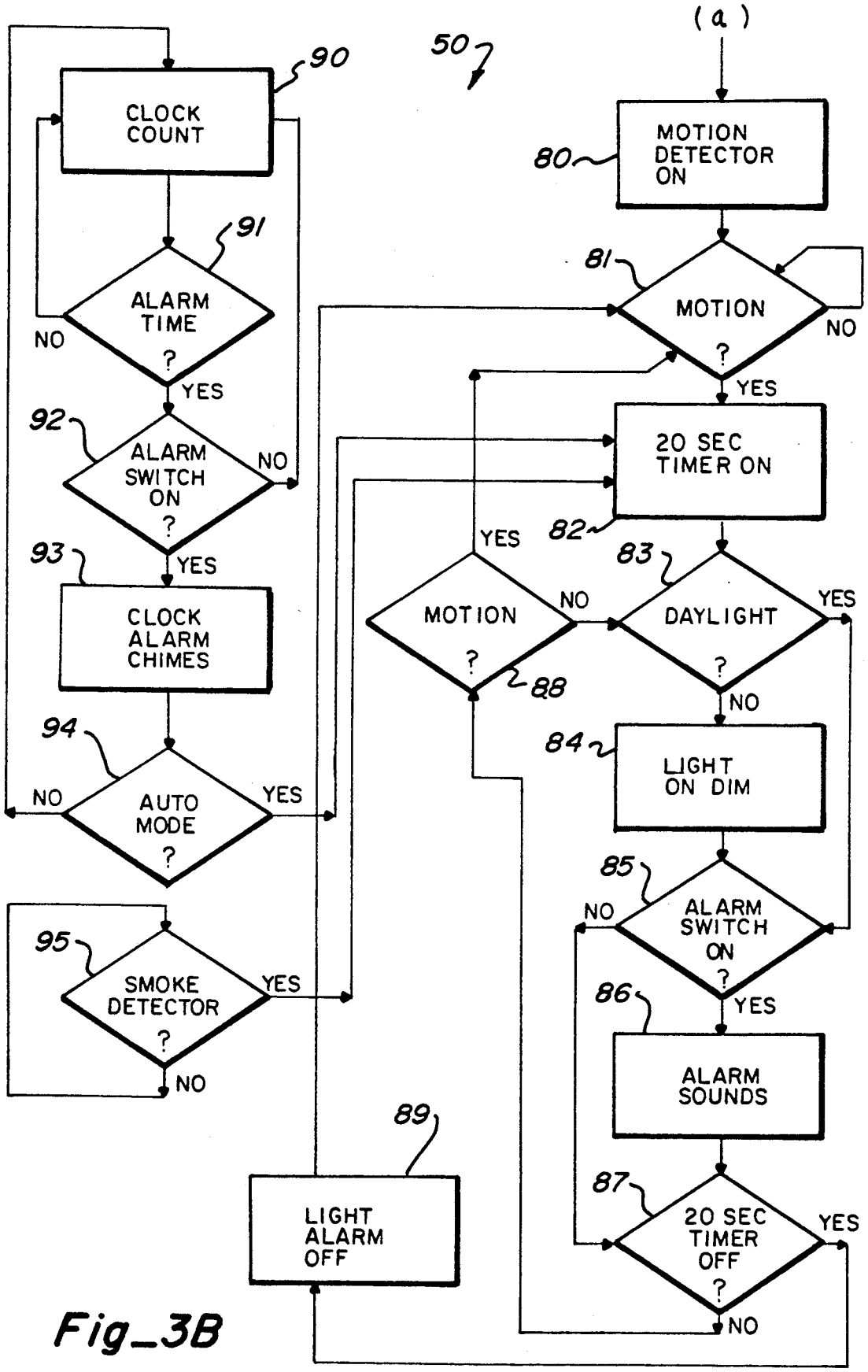

The nature of operation of the system 36 is established by the mode selection switch 34, the motion detector 18, the ambient light sensor 20 and the smoke detector 22. The lamp 16, the alarm 24 and the clock display 14 respond accordingly. A flow chart 50, shown in FIGS. 3A and 3B, illustrates these operations, functions, and responses. The flow chart 50 also illustrates one example of the software programming of the microprocessor 38 (FIG. 2). Functions and responses which are represented in the flow chart 50 are identified by separate reference numbers and the operational aspects are referenced with respect to the components described in FIG. 2.

The mode of operation of the system 36 is established at 52 by the user setting the mode switch 34 to a selected one of an "Off" position, a "Flash" position or "Auto" position. In the "Flash" mode of operation shown primarily in FIG. 3A, the objective is to activate the lamp 16 at a bright illumination level for an initial predetermined relatively long time period and thereafter keep the lamp on until no movement is detected for a predetermined relatively short time period. Thereafter, the bright level of illumination will again be initiated when motion is detected and for the relatively short time thereafter. In general, the "Flash" mode of operation provides high illumination during typical conditions when motion occurs. In the "Auto" mode of operation shown primarily in FIG. 3B, the objective is to activate the lamp 16 at a dim illumination level, and to selectively and optionally activate the alarm 24 when motion is detected and to keep the lamp and alarm activated so long as movement is detected and for a predetermined relatively short time period, unless there is sufficient ambient light to make illumination from the lamp unnecessary. In general, the "Auto" mode of operation provides adequate illumination for the user to see the clock display, to observe the physical details of an unfamiliar guest room or the like, to provide enough light in response to a security situation, such as an intruder or a fire, for the user to take defensive or other appropriate action, and to generally provide orientation when the user awakens, among other things. The clock and the smoke alarm preferably function independently of the "Flash" and "Auto" modes of operation selected. Upon the clock reaching the alarm time, or the smoke detector detecting a smoke condition, the alarm will signal the alarm condition. The characteristics of the alarm signal may be different to announce different types of alarm conditions.

In the "Off" mode of operation, the lamp 16 and the alarm 24 are both disabled as shown at 54 in FIG. 3A. Preferably, the clock alarm and the smoke detector alarm functionality remain continuously enabled, even though the alarm and the illumination may be disabled. Preferably the time keeping function of the clock remains enabled continuously, even though the display 14 may not display the time information unless desired by the user.

With the mode set at 52 to "Flash," motion detection is enabled at 56, a relatively long timing function is established by starting a timer at 58, the lamp 16 is lighted to a bright level of illumination at 60, and the lamp 16 is disabled from operating with a dim level of illumination at 62. The relatively long time period, started at 58, is a predetermined timeout interval which, in the preferred embodiment, is approximately two minutes. Counting occurs during this relatively long time interval during which a determination is made at 64 whether or not the relatively long time period has expired. So long as the relatively long time period has not expired as determined at 64, the lamp remains illuminated to a relatively bright level of illumination as shown at 60. Thus, at the commencement of the "Flash" mode of operation, the lamp is brightly illuminated and will remain brightly illuminated for the duration of the relatively long time period started at 58 and ended at 64. A bright level of illumination is available without regard to the level of ambient light and for the relatively long time period.

The continuation of the bright level of illumination after the expiration of the initial relatively long time period depends upon whether motion is detected at 66. Upon the detection of motion by the motion detector 18, a timer is set at 68 to count a relatively shorter time interval, which in the preferred embodiment is 20 seconds. Upon starting the count of the relatively short time period at 68, the lamp is also illuminated to the bright level at 70. Until the relatively short time interval expires, as is determined at 72, the lamp is continually illuminated at the bright level. If motion is detected prior to the expiration of the relatively short time interval at 72, timing of the relatively short time interval commences again as is shown at 68. Thus the bright level is maintained by the continued detection of motion within the relatively short time period beginning after the previous detection of motion.

A bright level of illumination is thus initiated at 60 upon selection of the "Flash" mode of operation, and is thereafter maintained until the expiration of the initial relatively long time period. The bright level of illumination will only be maintained thereafter at 70 by the detection of motion at 66 once during each relatively short time period. In order to terminate the illumination from the lamp, both the relatively long time period must have expired as determined at 64 and at 74, and the relatively short time period must have expired as determined at 72 and at 76. Under these conditions, i.e. expiration of both the relatively long and the relatively short time periods, the lamp is turned off at 78.

Once the lamp has turned off after the initial selection of the "Flash" mode, the lamp will be energized to the bright level of illumination upon the detection of motion. The motion detector continually checks at 66 for motion, and upon detecting motion the functionality represented at 68, 70, 72, 74 and 78 is again commenced.

The "Flash" mode is useful if the user is using the lamp as a flashlight or torch to light a darkened area. The lamp will remain on for the initial relatively long time period and thereafter so long as movement is detected within the predetermined relatively short time period. The "Flash" mode is also useful if the user is using the lamp to read himself or herself to sleep, or to illuminate the room until movement ceases, such as when the user stops stirring and goes to sleep. Directionality in motion detection is useful in this regard, to distinguish between the normal movement during sleep and the more overt movements of the user awakening or an intruder entering the room. At the selection of the user, the alarm may also be activated in conjunction with the detection of motion, but for most practical applications as an illumination device as opposed to a security device, the alarm will selectively be deactivated by the alarm switch 30. Many other practical applications will also be apparent.

In the "Auto" mode of operation selected at 52 the lamp 16 will be illuminated to a relatively dim level of illumination upon the detection of motion and provided that the ambient light level is sufficiently low to warrant illumination from the lamp. If no motion is detected or the ambient light level is high, the lamp will not light. The alarm 24 may also be selectively activated along with the lamp.

Upon entering the "Auto" mode shown primarily in FIG. 3B, the motion detector 18 is immediately activated at 80. The presence of detected motion is continually checked at 81. Upon the detection of motion, a timer is started at 82 to time a relatively short time period. The level of ambient light is checked at 83, and if the ambient light level is low, meaning that there is little or no daylight, the lamp is energized to a relatively low level of illumination at 84. If the level of ambient light is high, indicating the presence of daylight at 83, the lamp will not be illuminated. After the light is dimly illuminated at 84 or if adequate daylight makes illumination superfluous at 83 a determination is made at 85 of the state of the alarm switch 30. If the alarm switch 30 is on, as determined at 85, an alarm sounds at 86 or is otherwise announced. If the alarm switch is off as determined at 85 or after the alarm sounds at 86, the relatively short time period started at 82 is checked to determine if it has expired at 87.

If the relatively short time period has not expired, as determined at 87, and no motion is detected at 88, the sequence of functionality represented at 83, 84, 85, 86, 87 and 88 continually reoccurs. If motion is detected at 88 at anytime prior to the expiration of the relatively short time period as determined at 87, the functionality transitions to 81 and 82 to restart timing of the relatively short time period established at 82. Thus a determination of motion occurring within the relatively short time period will continually maintain the lamp illuminated to a relatively dim level, provided that there is a low level of ambient light. Upon the determination at 87 that the relatively short time period has expired, the lamp and the alarm, if either is activated, are turned off at 89. The functionality in the "Auto" mode thus reverts back to detecting motion at 81.

There are many practical applications for the device used in the "Auto" mode. If the user is using the device as a night light, illumination is readily obtained by an overt movement of the user from his or her bed. If the user should awaken disoriented, needs to find a ringing telephone or must get to the bathroom, by simply making an overt motion, the lamp will be activated and he or she will not need to fumble for the bedside lamp or risk injury from encountering an unexpected object in the dark. The lamp 16, because of its orientation within casing 12, also illuminates the clock display, such as by backlighting a conventional LCD display. The lamp is illuminated at a dimmed brightness, so the user's eyes will not be bothered by an overly bright light. If an intruder should enter the room while the user is asleep, the device will announce a warning to the user and illuminate the ambient environment sufficiently for the user to observe the situation. The device 10 may also used while the user is awake. The device may be turned to face a part of the room where the user in not present, such as a doorway or a window. If an intruder should enter this part of the room, the device will announce a warning and illuminate the ambient environment.

Accordingly, the user may select the "Flash" mode to obtain the bright level of illumination without the alarm when the user intends primarily to use the device as a night light activated from the user's own movement, or the user may select the "Auto" mode when the user desires to use the device as a security and alarm device.

In the "Off" mode, it may be preferable to disable all other condition sensing devices such as the motion detector 18 and the smoke detector 22, rather than simply disable the lamp and alarm as shown in FIG. 3A at 54. By disabling the condition sensing devices in addition to the light and the alarm, electrical power consumption is limited. However, the clock functionality should be maintained as is shown in FIG. 3B.

The clock functionality is maintained by a continual clock or time count at 90. Until the counted time reaches an alarm time, as determined at 91, the counting continues at 90. Upon the alarm time being reached, as determined at 91, the clock alarm switch 28 is checked at 92 to determine if the switch is on or off. If the clock alarm switch is off, the clock count at 90 continues. If the clock alarm switch is on, an alarm such as a chime occurs at 93. Preferably the alarm from the alarm clock is different than that of other types of alarms in order for the user to instantly recognize the difference between an alarm clock signal and a signal representative of some sort of security or personal concern condition.

After the clock alarm is given at 93, a determination is made at 94 of whether or not the user has selected the "Auto" mode of operation at 52 (FIG. 3A). If the "Auto" mode has not been selected the functionality continues with the clock count at 90. If the "Auto" mode has been selected at 94, the timer which times the relatively short time period is set at 82. Thereafter the functionality at 81, 82, 83, 84, 85, 86, 87, 88 and 89 commences in the same manner as described above.

Entering the "Auto" mode of operation from the alarm clock function offers several advantages. A dim level of illumination is instantly available in response to overt movement from the user upon awakening, and this level of illumination will remain so long as the movement continues. The dim level of illumination allows the user to become oriented, allows the clock display to be observed, and helps the user to find the various facilities. So long as motion occurs within the relatively short time period, or motion resumes after the relatively short time period, the dim level of illumination remains available to the user. Another advantage is the different and louder alarm sound to facilitate waking up such as might be required when the alarm wake-up time is very early or the user is in a different time zone.

Condition responsive or detecting means such as the smoke alarm may also have independent functionality within the device. As is shown at 95 in FIG. 3B, when the smoke detector detects the presence of smoke, the timer counting the relatively short time period is set at 82. Again the "Auto" mode of functionality is created which offers several advantages to the user. The dim level of light and the alarm are available to alert the user to the situation, and the dim level of light is adequate for the user to show an escape from the room. In the situation where smoke or some other life threatening condition is detected by use of other types of condition sensing devices, it is advantageous that the device be used as a flashlight, thereby making sure that illumination will always be available.

Figure 4A:
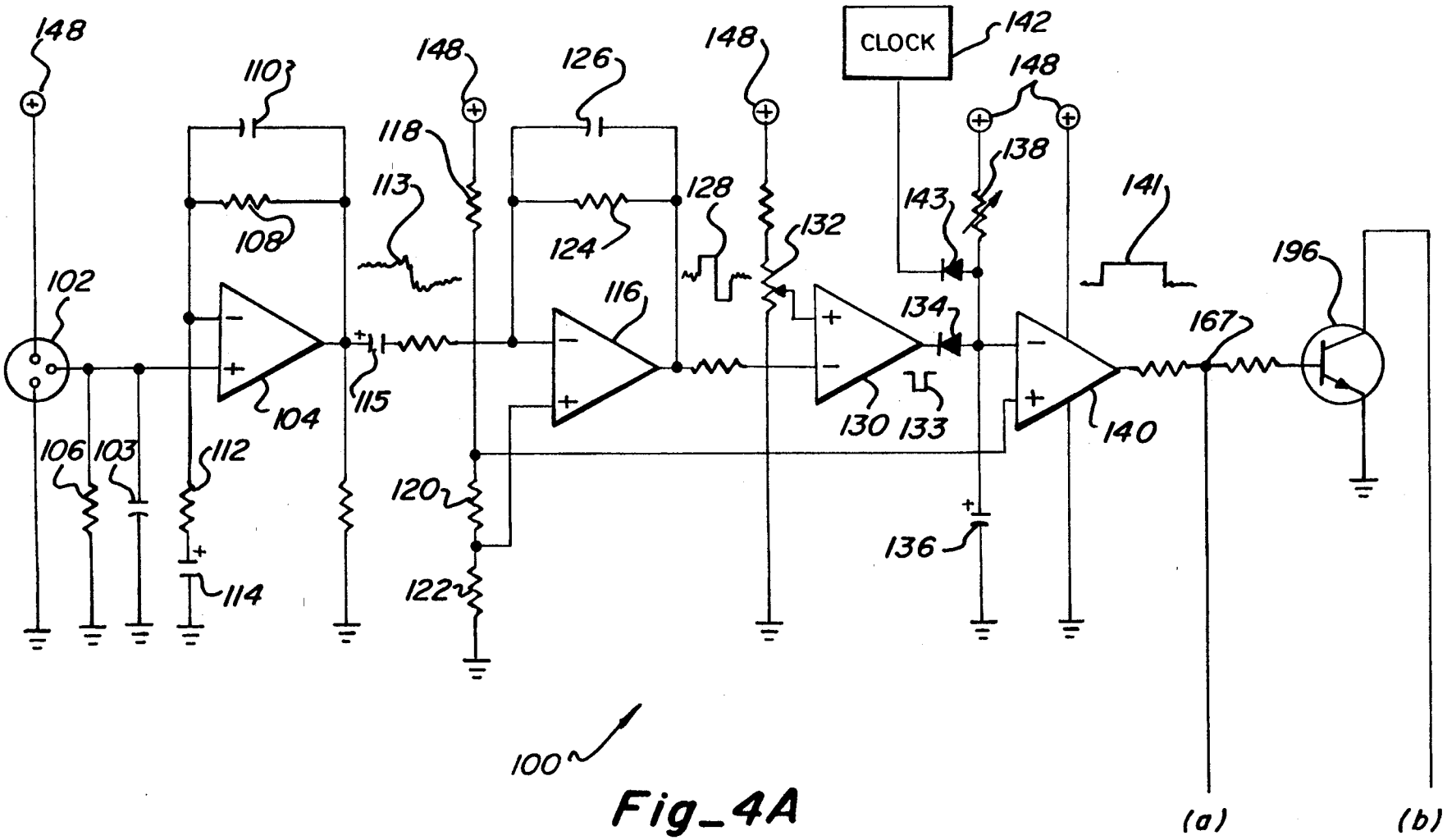
FIGS. 4A and 4B form a single schematic diagram illustrating another embodiment of the present invention.
Figure 4B:
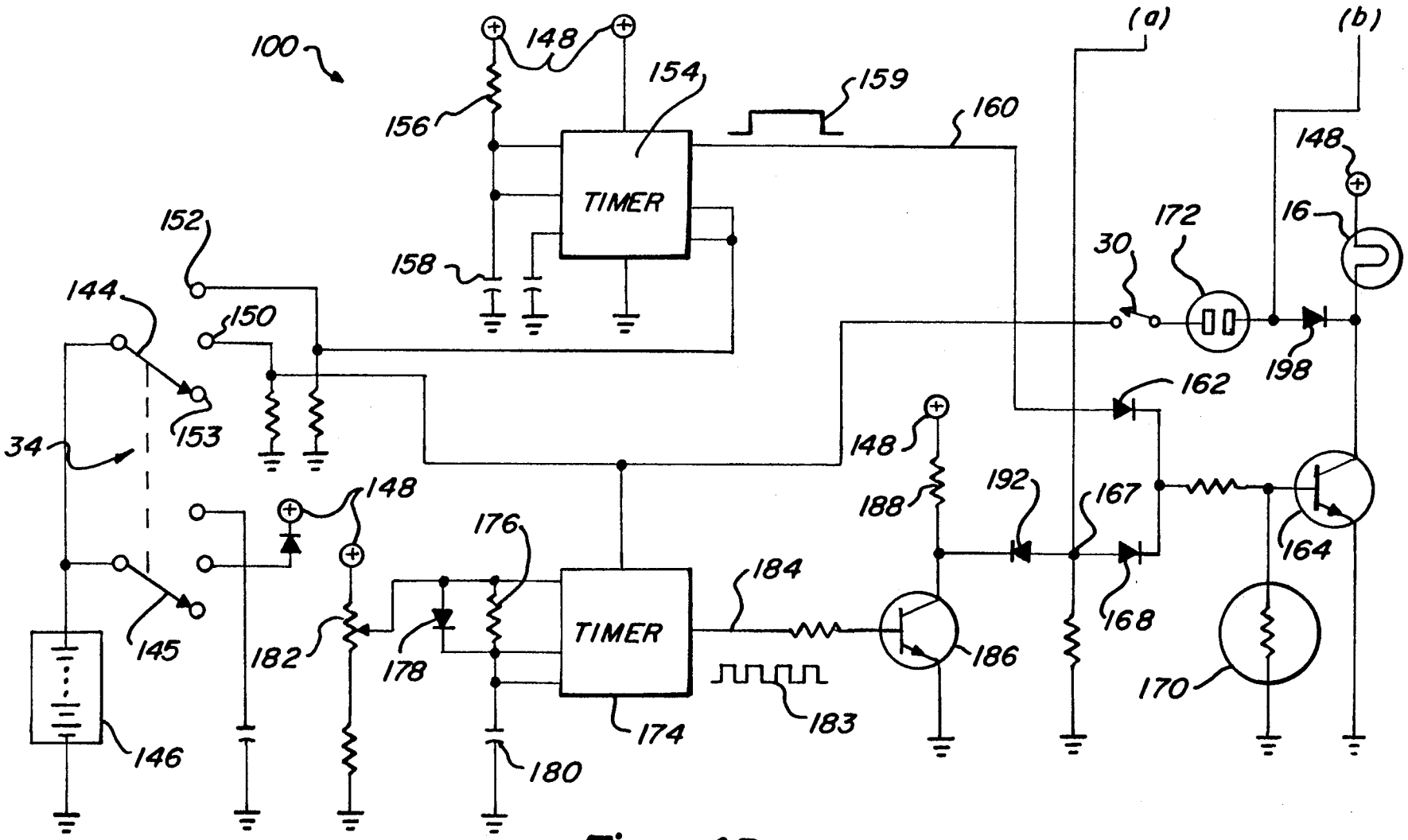

Another embodiment 100 of the present invention, which is illustrated in FIGS. 4A and 4B, implements many of the features previously described in conjunction with FIGS. 2 and 3. The embodiment 100 is implemented primarily using analog circuit elements and logical gating circuitry, as an alternative to the implementation shown in FIG. 2 which is primarily a digital implementation.

The embodiment 100 includes a conventional pyroelectric sensor 102 which is a passive, dual-element infrared motion detector transducer. Signals from the sensor 102 are applied to parallel combination of a capacitor 103 and resistor 106 and to the non-inverting input terminal of an operational amplifier ("op amp") 104. A resistor 108 and a capacitor 110, are connected in parallel in a feedback configuration from an output terminal to an inverting input terminal of the op amp 104. A resistor 112 and a capacitor 114 are also connected from the inverting input terminal to ground reference. The typical signal from the sensor 102 has a DC component which may gradually change in level or drift, and a superimposed AC component which relates primarily to motion detection and spurious background noise. The resistors 108 and 112 and the capacitors 110 and 114 operate in a conventional manner to eliminate extraneous high frequency components attributable to background noise, establish bias voltages to compensate for any gradual drift in DC signal level from the sensor 102, and still achieve responsiveness to signals from the sensor 102 indicative of detected motion.

Upon the detection of overt motion, each of the elements of the sensor 102 discharge deeply. Because of the nature of the connection of the elements in the sensor, the signal from the sensor 102 in response to the discharging elements includes a rapid positive-going pulse, as a result of the discharge of one of the elements, and a rapid negative-going pulse, as a result of the discharge of the other one of the elements. The positive-going and negative-going pulses occur relative to that quiescent level existing prior to the detection of motion. As a result, the detection of motion results in somewhat of an alternating pulse-like signal in which a positive-going pulse and a negative-going pulse always occur. The time width of the positive and negative pulses is related to the depth of discharge of the two elements of the sensor 102.

In contrast to the detection of motion, an immediate change in the ambient light level such as that achieved by the lights in a room being switched on or the lamp 16 (FIGS. 1 and 2) becoming illuminated, causes both elements of the sensor to be affected simultaneously with no net pulse-like signal being transmitted from the sensor 102. In the event of a slow changes to ambient light levels such as might occur at dawn, the elements of the sensor 102 are not responsive. When the circuit of the embodiment 100 experiences a surge in current, such as might happen when it activates a strong light, one element of the sensor discharges and produces a positive going pulse. Similarly, when the light is deactivated and the current drain through the circuit of the embodiment 100 immediately returns to normal, the other element of the sensor is discharged to cause a negative-going pulse. In the event of detection of motion or a rapid change in circuit current, but not in response to slow or rapid changes in the ambient light level, a rapid and significant change in level of the signal from the sensor 102 results.

The net effect of the biasing of the op amp 116 and of an op amp 140, as discussed below, is to reduce the sensitivity to the negative going pulses generated by the sensor when the light is deactivated at the expiration of the time constants, but to maintain the sensitivity to the positive going pulses generated by motion. At the time of detecting motion, and therefore generating a positive pulse, another positive pulse is generated immediately by the sensor in response to the change in current as the light turns on, but the effect is masked by the fact of the motion pulse. In the case of a large discharge of a sensor element as might be caused by a large range of motion or motion close to the elements, the two positive pulses merge into a longer single one.

The op amp 104 delivers an amplified output signal 113 at its output terminal which is related to the type of change in the input signal supplied by the sensor 102 to the input terminal of the op amp 104. A capacitor 115 couples AC fluctuations at the output terminal of the op amp 104 to an inverting input terminal of another op amp 116, while blocking the application of the DC level of the output signal from op amp 104. The op amp 116 serves as an inverting amplifier and filter. A resistive network formed by resistors 118, 120 and 122 develops a signal at the junction of resistors 120 and 122 which is applied to the non-inverting input terminal of the op amp 116. A resistor 124 and capacitor 126 are connected in a conventional feedback network between the output terminal of the op amp 116 and the inverting input terminal. The signal changes coupled through capacitor 115 causes an rapid and opposite output response from the op amp 116.

In response to the alternating sequential positive-going pulse and negative-going pulse supplied from the sensor 102 and amplified by the op amp 104, the signal at the output terminal of the op amp 116 assumes somewhat of an alternating square wave configuration 128, because the amplification from the op amp 116 causes the signal 128 to move between the positive and reference potentials to which the op amp 116 is connected. The time width of each of the positive-going and negative-going square wave pulses of the square wave signal 128 is determined by the time constant of the discharge of the elements of the sensor.

The alternating square wave signal 128 which is created at the output terminal of op amp 116 is applied to the inverting input terminal of op amp 130. The non-inverting input terminal of op amp 130 is connected to the variable wiper of a potentiometer 132. The op amp 130 functions as a comparator and sensitivity control. The signal level at the non-inverting input terminal, which is established by the setting of the potentiometer 132, controls the level at which the comparison is achieved. Upon the signal from the output terminal of op amp 116 rising positive during the positive-going pulse component of an alternating square wave, the op amp 130 supplies a negative output pulse 133.

The negative pulse 133 is coupled through the diode 134 to discharge a capacitor 136, which has previously been charged from the power supply through a potentiometer 138. When the capacitor 136 discharges, the signal level at the inverting input terminal of the op amp 140 drops. The signal level at the non-inverting input terminal to the op amp 140 exceeds the level of the signal at the inverting terminal, and the op amp 140 supplies a high level output signal 141. So long as the capacitor 136 is discharged to a level below that at the non-inverting input terminal, the op amp 140 will maintain a high level signal 141. Thus so long as motion is detected, the capacitor 136 will be discharged. Only after motion is not detected will the capacitor begin to charge.

The signal at the non-inverting input terminal of the op amp 140 remains greater than the signal at the negative input terminal for a time period related to the time constant of the potentiometer 138 and the capacitor 136 This time constant is adjustable by varying the resistivity of the potentiometer 138. As a consequence of adjusting the time constant of elements 136 and 138, the width of the positive output pulse 141 from the output terminal of the op amp 140 is adjusted for individual needs, for example up to 50 seconds in the preferred embodiment. In the preferred embodiment, the time width of the pulse signal 141 is approximately 20 seconds and is preferably the relatively short time period established in FIGS. 3A and 3B. Thus, should motion be detected before the signal level on the capacitor 136 has reached a level sufficient to cause the op amp 140 to supply a low output signal, the capacitor will discharge. Thereafter, the capacitor will again start charging. So long as motion is detected prior to the capacitor reaching a level which causes the op amp 140 to switch output states, the output signal will remain at a high level.

The positive-going pulse created by the sensor 102 in response to an immediate increase in the current drawn by the circuit of the embodiment 100 and during the discharge of one of the elements of the sensor 102 immediately after the detection of motion, is coupled through and amplified by the op amps 104 and 116 and is applied to the inverting input terminal of the op amp 130. The resulting output signal from the op amp 130 is a negative-going pulse. Since the op amp 140 has already been triggered by the immediately preceding negative pulse resulting from the detection of motion, this further negative pulse has no effect. When the lamp turns off, the resultant negative going pulse from the sensor 102 caused by the change in current drain is coupled to the op amp 130 which is biased by the resistors 118, 120 and 122 to ignore this pulse. A positive signal appears at the output of the op amp 130. This positive pulse back biases the diode 134, and no effect on the charged state of the capacitor 136 or on the circuit as a whole occurs. Therefore, since only the positive-going pulses are indicative of detected motion, and because the portion of embodiment 100 shown in FIG. 4A effectively differentiates between the positive-going pulses which unambiguously represent detected motion and the negative-going pulses which are ambiguous because they either represent detected motion or an increase in ambient light level, the signal 141 is supplied only in response to the detection of motion.

A clock 142 is a conventional alarm clock and has its own power source, self contained display, and time and information and alarm set point functionality. Its display is back lighted from a lamp of the device. A signal from the clock 142 is coupled through a diode 143 which is also connected to the capacitor 136. Upon the clock 142 count reaching an alarm time, a negative going or ground signal is coupled through the diode 143 to discharge the capacitor 136. The discharged capacitor causes the output signal 141 to be generated in the same manner and for the same duration as has been previously described in response to the detection of motion. A similar arrangement could be employed to obtain condition responsive control signals from the smoke detector 28 (FIG. 2) or other condition detecting means. Like the clock 142, the condition detecting means is connected through a diode to discharge the capacitor 136, thereby creating the output signal 141.

The mode switch 34 includes two ganged switch elements 144 and 145. The element 145 connects a battery 146 to a positive terminal 148 which supplies power to the components of the embodiment 100. The other switch element 144 allows the user to select the "Flash" mode, the "Auto" mode, or the "Off" mode. The "Auto" mode is achieved by moving the switch element 144 to connect the positive terminal of the battery 146 to terminal 150. The "Flash" mode is achieved by connecting the element 144 to the terminal 152 The "Off" mode is achieved by connecting the element 144 to the terminal 153.

In the "Flash" mode, a signal from the battery 146 is applied to a monostable timer 154. The timer 154 is a conventional integrated circuit component, part number 7556. A resistor 156 is connected to a capacitor 158, and the midpoint junction of these two elements is connected to the timer 154. The time constant of the resistor 156 and capacitor 158 establishes the time duration of a high output signal 159 on conductor 160 supplied by the timer 154. The time period during which the signal 159 on conductor 160 remains high is relatively long, for example two minutes in the preferred embodiment.

The time period of the duration of the high level of the signal 159 and the time period duration of the high level of the signal 141 cooperate to establish the interaction of the relatively long and relatively short time periods described in FIGS. 3A and 3B. The signal 159 on conductor 160 is conducted through a diode 162 to the base of transistor 164. The signal 159 is sufficient in magnitude to trigger the transistor 164 into continual conduction, thereby causing a relatively great current to flow continuously through the lamp 16 and light it brightly. The signal 141 is applied to a node 167 and through a diode 168 to the base of the transistor 164. The signal 141 will also cause the transistor to conduct continuously a sufficient amount of current to light the lamp 16 brightly. Thus the level of the signals 141 and 159 is each sufficient to cause the transistor 164 to conduct enough current to light the lamp 16 brightly. The lamp 16 will light brightly for the duration of the longest existing signal.

When the mode switch 34 is first turned to the "Flash" position, the timer 154 will insure that the signal 159 immediately causes the lamp to light brightly. After the expiration of the relatively long time period during which the signal 159 is high, the detection of motion will cause the signal 141 to attain and maintain that high level until the predetermined time period (established by the time constant of elements 136 and 138) expires after motion is last detected. Thus after the initial time period established by the signal 159, the signal 141 maintains the lamp lighted brightly for a predetermined time period after which motion is no longer detected.

A photo resistor 170 is connected to the base of transistor 164. The photo resistor 170 functions as one embodiment of the ambient light sensor 20 (FIG. 2). The photo resistor 170 controls the conductivity of the transistor 164 in relation to the level ambient light. The photo resistor exhibits a lower resistivity when exposed to greater amounts of ambient light and a higher resistivity when exposed to lesser intensities of light. When the photo resistor 170 exhibits higher resistivity, the signal applied to the base of transistor 164 is effective to cause the transistor 164 to conduct. When the resistivity of the photo resistor is low, the signal applied to the base of the transistor 164 is largely shunted to the ground reference through the photo resistor 170.

The resistivity characteristics of the photo resistor 170 and the gain and conductivity characteristics of the transistor 164 are selected so that the transistor 164 will conduct sufficient current to light the lamp 16 brightly in response the to constant high level signals 141 and 159 applied through the diodes 168 and 162, respectively, regardless of the ambient light level sensed by the photo resistor 170. Thus the ambient light level does not defeat the delivery of a bright level of light when operating in the "Flash" mode. In this manner, the lamp 16 will be brightly lighted regardless of the ambient light level.

When the mode switch 34 is moved to position switch element 144 in contact with terminal 150 in the "Auto" position, power is supplied to the alarm switch 30. Closure of the switch 30 connects a buzzer 172 to the battery 146. The flow of current through the buzzer 172 causes it to emit an audible sound or signal. The buzzer 172 functions as one embodiment of the alarm 24 (FIG. 2).

Positioning the switch in the "Auto" mode also activates an oscillator 174. The oscillator 174 is formed using a conventional bistable multivibrator, using a component similar to that at 154, to which a resistor 176, diode 178, capacitor 180, and potentiometer 182 are connected to its input terminals. The elements 176, 178, 180 and 182 cause the oscillator 174 to supply a repeating output square wave 183 by repeatedly charging and discharging the capacitor 180. The duty cycle of the charge and discharge operation is established by the position of the potentiometer 182. The periodic square wave signal 183 is supplied on a conductor 184 in response to the charging and discharging of the capacitor 180.

The periodic square wave signal 183 is applied to the base of a transistor 186 which, in response thereto, switches current through a resistor 188. When the transistor 186 is conductive, any signal present at node 167 is shunted to the ground reference through the conductive transistor 186 and diode 192. When the transistor 186 is not conductive during the time when the square wave signal 183 is low, a high level signal 141 at node 167 is conducted through the diode 168 to the base of transistor 164.

The transistor 164 is thus turned on and off at the frequency and the duty cycle of the square wave signal 183 only when the signal 141 is present at node 167 and is conductive during the time that the signal 183 is high if the signal level at node 167 is high. Since the signal applied to the base of transistor 164 is not high continuously, the average based drive current is reduced by the on and off switching. This average reduced level of base drive current is influenced by the resistivity of the photo resistor 170. When the ambient light is low and the resistivity of the photo resistor 170 is high, and average base drive current applied to the transistor 164 is sufficient to cause the transistor 164 to be conductive, but to a reduced extent. The degree of current conducted through the lamp 16 is reduced and the illumination provided by the lamp 16 is reduced. When the ambient light level is high, the lower resistivity of the photo resistor shunts sufficient current to ground to reduce the average base drive current to the base of transistor 164 to prevent the transistor from conducting a sufficient amount of current to light the lamp 16. Thus in the "Auto" mode, the lamp is lighted to a dimmed brightness when motion is detected and for a predetermined time thereafter, as represented by the presence of the signal 141. The degree of reduction in brightness is determined by varying the extent of time that the signal 183 is high during each oscillation delivered from the oscillator 174, which is established by the values of the elements 176, 180 and 182, by the conductivity characteristics of the transistor 164 and by the light responsive resistivity characteristics of the photo transistor 170.

The buzzer 172 will also be turned on by the high level signal 141 supplied upon the detection of motion, provided that the alarm switch 30 is closed. The signal 141 biases transistor 196 (FIG. 4A) into conduction, which draws current through the buzzer 172 and causes an audible alarm. This audible alarm will occur regardless of whether the ambient light causes the transistor 164 to be conductive, and the diode 198 causes the transistor 196 to control the conductivity of the buzzer 172 independently from the conductivity of the transistor 164. The diode 198 also prevents the conductive transistor 196 from drawing current through the lamp 16 and lighting it. Thus, the transistor 164 exclusively controls the lighting of the lamp 16. Unless the switch 30 is opened, the buzzer 172 will also sound when the lamp 16 is lighted brightly in the "Flash" mode.

Thus, the embodiment 100 illuminates the lamp 16 to its full brightness in the "Flash" mode. The lamp 16 will remain illuminated for the relatively long time period established by the timer 154 and the time constant of the elements 136 and 138. Depending on the position of the switch 30, the buzzer 172 is also sounded. The lamp is illuminated brightly even if the ambient light level is relatively high. In the "Auto" mode and with a low level of ambient light, the intensity of light from the lamp 16 is dimmed. The light in the "Auto" mode is only available so long as motion is detected and for a predetermined time period after motion ceases. The buzzer 172 will be activated in the "Auto" mode only if the user elects to close the switch 30.

From the forgoing description, it is apparent that the embodiments of the present invention offer many advantages not previously available. The mode selection switch and the motion detector effectively controls the conditions under which light will be delivered, to illuminate a previously darkened area, to illuminate or reveal the clock time display and to cease the illumination when light is no longer needed. The alarm signals are selectively available both in response to the detection of motion and under the other conditions when light is emitted, at the selection of the user. The dim level of Illumination is prevented when the level of ambient light makes it unnecessary, but the bright level of illumination is always available. The capability to detect smoke and intruder motion makes the invention useful as a safety device, and the clock provides information to the user. These features are advantages in many circumstances, but they are particularly useful for the traveler who must temporarily reside in unfamiliar surroundings.

Presently preferred embodiments of the present invention and many of its improvements have been described with a degree of particularity. The previous description is of the preferred example for implementing the invention, but the scope of the invention should not be limited by this description. The scope of the present invention is defined by following claims.

The invention claimed is:

1. An apparatus comprising the combination of:

clock means for counting time;

clock display means for displaying information describing the time counted by the clock means;

alarm means for selectively delivering an alarm indication in an ambient environment generally surrounding said apparatus, the alarm means including an audible alarm device and a source of illumination which illuminates the ambient environment generally surrounding said apparatus and which illuminates the clock display;

condition detecting means for detecting a predetermined condition in the ambient environment generally surrounding said apparatus; and means interconnecting the clock means, the clock display means, the alarm means and the condition detecting means and operative for activating the alarm means upon the condition detecting means detecting the predetermined condition, for activating the alarm means upon the clock means counting to a predetermined time, and for activating the clock display means.

2. An apparatus as defined in claim 1 wherein the condition detecting means comprises:

a smoke detector for detecting smoke in the ambient environment generally surrounding said apparatus; and wherein:

the interconnecting and activating means activates one of the audible alarm device or the illumination source upon the detection of smoke by the smoke detector.

3. An apparatus as defined in claim 2 wherein:

the interconnecting and activating means activates the illumination source and the audible alarm device simultaneously.

4. An apparatus as defined in claim 2 wherein:

the interconnecting and activating means comprises a microcomputer.

5. An apparatus as defined in claim 2 wherein:

the interconnecting and activating means comprises an analog circuit.

6. An apparatus as defined in claim 1 wherein the apparatus is contained within a housing of a size convenient for packing in one of a suitcase, purse or pocket when travelling.

7. An apparatus comprising the combination of:

clock means for counting time;

clock display means for displaying information describing the time counted by the clock means;

alarm means for selectively delivering an alarm indication in an ambient environment generally surrounding said apparatus, the alarm means including a source of illumination and an audible alarm device;

condition detecting means for detecting a predetermined condition in the ambient environment generally surrounding said apparatus including a motion detector for detecting motion in the ambient environment generally surrounding said apparatus; and means interconnecting the clock means, the clock display means, the alarm means and the condition detecting means and operative for activating the alarm means upon the condition detecting means detecting the predetermined condition, for activating the alarm means upon the clock means counting to a predetermined time, for activating the clock display means, and for activating one of the audible alarm device for the illumination source upon detection of the motion by the motion detector.

8. An apparatus as defined in claim 7 wherein:

the interconnecting and activating means activates the illumination source upon the detection of motion by the motion detector and thereafter deactivates the illumination source after the absence of motion is detected.

9. An apparatus as defined in claim 7 wherein:

the interconnecting the activating means activates the illumination source upon the detection of motion by the motion detector and thereafter deactivates the illumination source after the expiration of a predetermined time during which no motion was detected.

10. An apparatus as defined in claim 7 further comprising:

mode selection means for selecting one of a first mode of operation or a second mode of operation; and wherein:

the interconnecting and activating means activates the illumination source to brightly illuminate the ambient environment upon the detection of motion by the motion detector in the first mode of operation and to dimly illuminate the ambient environment upon the detection of motion by the motion detector in the second mode of operation.

11. An apparatus as defined in claim 10 wherein:

the interconnecting and activating means deactivates the illumination source after the motion detector detects no motion.

12. An apparatus as defined in claim 11 wherein:

the interconnecting the activating means activates the illumination source and the audible alarm device simultaneously.

13. An apparatus as defined in claim 10 wherein:

the one of the bright or dim illumination is maintained so long as the motion detector detects motion within a predetermined time period.

14. An apparatus as defined in claim 13 wherein:

the predetermined time period starts anew with each instance of detected motion in both modes of operation.

15. An apparatus as defined in claim 10 wherein in the second mode of operation:

the illumination source is deactivated after the expiration of a predetermined time during which no motion is detected by the motion detector.

16. An apparatus as defined in claim 15 wherein:

the interconnecting and activating means activates the illumination source and the audible alarm device simultaneously.

17. An apparatus as defined in claim 7 wherein the condition detecting means further comprises:

a smoke detector for detecting smoke in the ambient environment generally surrounding said apparatus; and wherein:

the interconnecting and activating means activates one of the audible alarm device or the illumination source upon either one of the detection of smoke by the smoke detector or the detection of motion by the motion detector motion.

18. An apparatus as defined in claim 17 wherein:

the interconnecting and activating means activates the illumination source and the audible alarm device simultaneously.

19. An apparatus comprising the combination of:

clock means for counting time;

clock display means for displaying information describing the time counted by the clock means;

alarm means for selectively delivering an alarm indication in an ambient environment generally surrounding said apparatus, the alarm means including a source of illumination and an audible alarm device;

condition detecting means for detecting a predetermined condition in the ambient environment generally surrounding said apparatus, the condition detecting means including a motion detector for detecting motion in the ambient environment generally surrounding said apparatus; and means interconnecting the clock means, the clock display means, the alarm means and the condition detecting means and operative for activating the alarm means upon the condition detecting means detecting the predetermined condition, for activating the alarm means upon the clock means counting to a predetermined time, for activating the clock display means, and for simultaneously activating the audible alarm device and the source of illumination upon the clock means counting to a predetermined alarm time.

20. An apparatus as defined in claim 19 wherein:

the interconnecting and activating means further maintains the activation of the illumination source for a predetermined time after the clock means counts to the predetermined alarm time and while motion is detected thereafter and for a predetermined time period after which motion is no longer detected.

21. An apparatus comprising the combination of:

a source of directed light for illuminating an ambient environment surrounding said apparatus from a first direction;

alarm means for selectively delivering an audible alarm indication in the ambient environment generally surrounding said apparatus;

motion detector means for detecting motion from a second different direction in the ambient environment generally surrounding said apparatus; and means interconnecting the illumination source, the alarm means and the motion detector means and operative for activating the illumination source and alarm means upon the motion detector means detecting motion, wherein the apparatus is contained within a housing of a size convenient for packing in one of a suitcase, purse, or pocket when traveling.

22. An apparatus as defined in claim 21 wherein:

the interconnecting and activating means deactivates the illumination source and the alarm means after the motion detector means detects no motion.

23. An apparatus as defined in claim 22 wherein:

the illumination source and the alarm means are deactivated after the expiration of a predetermined time during which the motion detector means detects no motion.

24. An apparatus as defined in claim 22 further comprising:

mode selection means for selecting one of a first mode of operation or a second mode of operation; and wherein:

the interconnecting and activating means activates the illumination source to illuminate the ambient environment relatively brightly upon the motion detector means detecting motion in the first mode of operation and to illuminate the ambient environment relatively dimly upon the motion detector means detecting motion in the second mode of operation.

25. An apparatus as defined in claim 24 wherein:

the one of the bright or dim illumination is maintained while the motion detector detects motion within a predetermined time period.

26. An apparatus as defined in claim 25 wherein:

the predetermined time period starts anew with each instance of detected motion in both modes of operation.

27. An apparatus as defined in claim 24 wherein in the second mode of operation:

the illumination source is deactivated after the expiration of a predetermined time during which the motion detector means detects no motion.

28. An apparatus as defined in claim 21 further comprising:

a smoke detector means for detecting smoke in the ambient environment generally surrounding said apparatus; and wherein:

the interconnecting and activating means activates the illumination source and the alarm means upon either one of the smoke detector means detecting smoke or the motion detector means detecting motion.

29. An apparatus comprising the combination of:

a source of illumination for selectively brightly illuminating an ambient environment generally surrounding said apparatus and for selectively dimly illuminating the ambient environment generally surrounding said apparatus;

motion detector means for detecting motion in the ambient environment generally surrounding said apparatus; and means interconnecting the illumination source and the motion detector means and operative for activating the illumination source to brightly illuminate the ambient environment upon the motion detector means detecting motion and to dimly illuminate the ambient environment upon the motion detector means detecting motion, the interconnecting and activating means further deactivating the illumination source after the motion detector means detects no motion, and the interconnecting and activating means further selectively activating the illumination source to create one of either the bright or dim illumination.

30. An apparatus as defined in claim 29 further comprising:

mode selection means connected to the interconnecting and activating means for selecting either the bright or dim illumination.

31. An apparatus as defined in claim 29 wherein;

the illumination source is deactivated after the expiration of a predetermined time during which the motion detector means detects no motion.

32. An apparatus as defined in claim 31 wherein:

the predetermined time period starts a new with each instance of detected motion.

33. An apparatus as defined in claim 29 further comprising:

a smoke detector means for detecting smoke in the ambient environment generally surrounding said apparatus; and wherein:

the interconnecting and activating means activates the illumination source upon either one of the smoke detector means detecting smoke or the motion detector means detecting motion.

34. An apparatus as defined in claim 29 further comprising:

alarm means for selectively delivering an alarm indication in an ambient environment generally surrounding said apparatus; and wherein:

the interconnecting and activating means activates the illumination source and the alarm means simultaneously.

35. An apparatus as defined in claim 29 wherein the apparatus is contained within a housing of a size convenient for packing in one of a suitcase, pocket or purse when travelling.

* * * * *